United States Patent [19]

Newman

[11] 4,330,394

[45] May 18, 1982

[54] QUENCHING PROCESS

[75] Inventor: John O. H. Newman, Cheltenham, England

[73] Assignee: Coal Industry (Patents) Limited, London, England

[21] Appl. No.: 194,796

[22] Filed: Oct. 7, 1980

[30] Foreign Application Priority Data

Oct. 26, 1979 [GB] United Kingdom ..... 7937257

[51] Int. Cl.[3] ..... C10C 1/00; C10G 45/00

[52] U.S. Cl. ..... 208/23; 208/48 Q; 208/56

[58] Field of Search ..... 208/23, 48 Q, 56; 201/24, 29

[56] References Cited

U.S. PATENT DOCUMENTS

| | | | |
|---|---|---|---|
| 2,776,727 | 1/1957 | Boisture | 208/48 Q |
| 3,440,163 | 4/1969 | Hammer | 208/48 Q |
| 4,233,137 | 11/1980 | Ozaki | 208/48 Q |
| 4,279,733 | 7/1981 | Gwyn | 208/48 Q |

FOREIGN PATENT DOCUMENTS

| | | | |
|---|---|---|---|
| 873004 | 7/1961 | United Kingdom | 208/48 Q |

*Primary Examiner*—T. Tufariello

*Attorney, Agent, or Firm*—Stevens, Davis, Miller & Mosher

[57] ABSTRACT

The tar vapors from carbonizing coal, preferably in a fluidized bed, are treated by quenching with a hydrogen-donor solvent. Tar molecules prone to polymerization upon condensation and upon distillation are partially hydrogenated; the resulting tar solution is of lower viscosity and less likely to coke or form pitch.

8 Claims, No Drawings

QUENCHING PROCESS

This invention concerns the treatment of gases or vapors resulting from the carbonization of coal.

It is well known that the carbonization (also known as pyrolysis) of coal evolves gases or vapor rich in tar. The tar contains a large variety of substances, and includes oil components. The oil components are known as solvents for coal in the liquefaction of coal and it has been suggested that liquid fuels and/or chemical feedstocks can be produced by upgrading the oils by hydrotreatment.

Our studies of coal tars have met with the problem of high molecular wight material in the tar; much of this material is formed by polymerization of simpler molecules, which polymerisation can occur in the vapor phase and during and after condensation. The polymers tend to coke when tar is distilled or hydrogenated. Hydropyrolysis, the carbonization of coal under high pressure hydrogen, as well as upgrading the tar oils also reduces considerably the polymerisation reaction. However, hydropyrolysis has the severe disadvantages of the problems associated with feeding solids into and out of high pressure systems, and of large hydrogen consumption because of the formation of by-product methane.

The present invention provides a method of treatment of tar vapors from the carbonization of coal comprising quenching the vapours using a hydrogen donor.

The invention also provides a method of carbonizing coal in which the tar vapors evolved are quenched using a hydrogen donor.

Preferably, the quenching cools the tar vapors to a temperature of below 400° C., more preferably to below 200° C.

The coal to be carbonized may be a bituminous or lower rank coal such as brown coal, but is preferably a high or medium-volatile bituminous coal.

The carbonization may be carried out on a static charge of coal, or in a disperse phase, but is preferably carried out as a fluidized bed carbonization. Temperature for carbonization may be in the range 500° to 650° C., and carbonization is suitably carried out at or very close to atmospheric pressure. Carbonization may be carried out under a reactive gas such as steam, carbon dioxide or hydrogen. Although these conditions are thought to be the most advantageous, it is believed that the present invention offers improvements in other processes of carbonization such as flash pyrolysis.

Hydrogen donors are known as solvents for the degradation and liquefaction of coal. In the liquefaction of coal it is thought that available hydrogen from the solvent is donated to the degrading coal structure, thereby stabilizing the soluble molecular fragments as they are formed. The hydrogen donor in turn reverts to a stable unsaturated form which may subsequently or concurrently be regenerated by conventional hydrogenation techniques. Typical hydrogen donors are hydroaromatics, and solvents preferred for use in the present invention are hydrogenated tar oils and tetralin, although tetrahydroquinoline and o-cyclohexylphenol are also suitable. Hydrogen donors may also be used which arise directly or by hydrotreatment of products arising from a process using the invention.

The quenching may be carried out in accordance with established chemical engineering principles, for example by spraying with the hydrogen donor. Conveniently, the invention is used as part of a process in which the 'used' donor in dehydrogenated form is regenerated by hydrogenation for re-use, and the regenerated donor is cooled before the quenching step. Preferably, the quenching is carried out as soon as practicable after the formation of the vapors, in order to minimize the opportunity for polymerization of the coke-forming precursors.

The invention provides as a product a stabilized tar solution comprising carbonization tar and hydrogen donor in which the quantity by weight of tar to hydrogen donor is from 1:0.5 to 1:10, preferably 1:1 to 1:5. The presence of the hydrogen donor reduces the viscosity of the tar thus permitting easy further processing. In addition, the lower viscosity is of considerable assistance when the tar is from a fluidized carbonizer in that the fine char contaminant can be more easily removed, for example by filtering or settling. It will be appreciated that the hydrogen donor donates hydrogen to the tar components having most need of it in the quenching step and therefore becomes itself dehydrogenated. The product is therefore different from that which would result from dissolving condensed tar (which already contains polymerized components) in a hydrogen donor.

The tar solution may be fractionated, for example under reduced pressure to remove the dehydrogenated donor. The donor and the recovered tar may be then each separately catalytically hydrogenated in known manner, the donor being recycled to the quenching step and the hydrogenated tar being processed to chemical feedstock and fuel. Alternatively, the tar solution may be catalytically hydrogenated and then fractionated to yield the regenerated donor for recycle and to yield hydrogenated tar oil. It is believed that this latter process would be especially advantageous because of the hydrogen transfer characteristics of the donor.

The invention will now be described by way of example only.

EXAMPLE

A high volatile bituminous coal (from Linby colliery, England) was fed into a bed of fluidized sand heated to 600° C. by external heaters, at a rate of 1 Kg/hr. The bed was fluidized with nitrogen. Immediately that the vapors evolved from the decomposition of the coal were carried, by the flow of nitrogen, out of the vessel containing the fluidized bed, they were quenched by a spray of tetralin from a spray head mounted in a bend in the tube carrying the vapors and arranged so that the spray completely filled the tube. The temperature of the vapors immediately before the quench spray was approximately 600° C. and this was reduced to approximately 100° C. thereafter.

The quenched vapors were taken into a receiving pot cooled by a coil carrying cold water, from which a high quality tar was recovered and taken for analysis. Tetralin was recycled to the spray although it was found that the nitrogen gas still carried an amount of tetralin thus necessitating further cooling of the gas to avoid loss.

I claim:

1. A method of treatment of tar vapors from the carbonization of coal, to produce a stabilized coal tar product comprising quenching the vapors to a temperature of below 400° C. by using a hydrogen donor liquid effective to donate hydrogen from itself to tar components under the process conditions in a weight ratio of 10:1 to 0.5:1 of the tar vapors.

2. A method as claimed in claim 1, wherein the quenching cools the tar vapors to a temperature of below 200° C.

3. A method as claimed in claim 1, wherein the hydrogen donor is a hydrogenated tar oil or tetralin.

4. A method of carbonizing coal, wherein the tar vapours evolved are treated using the method of claim 1.

5. A method as claimed in claim 4, wherein the carbonization is a fluidized bed carbonization carried out at a temperature in the range 500° to 650° C.

6. A method as claimed in claim 4, wherein the carbonization is carried out in the presence of a reactive gas.

7. A stabilized tar solution comprising carbonization tar quenched with hydrogen donor as claimed in claim 1, in which the quantity by weight of tar to hydrogen donor is from 1:0.5 to 1:10.

8. A solution as claimed in claim 7, in which the quantity by weight of tar to hydrogen donor is from 1:1 to 1:5.

* * * * *